US008651218B2

(12) United States Patent
Okada

(10) Patent No.: US 8,651,218 B2
(45) Date of Patent: Feb. 18, 2014

(54) CONSTRUCTION MACHINE

(75) Inventor: Koji Okada, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 671 days.

(21) Appl. No.: 12/619,888

(22) Filed: Nov. 17, 2009

(65) Prior Publication Data

US 2010/0126791 A1 May 27, 2010

(30) Foreign Application Priority Data

Nov. 25, 2008 (JP) ..... 2008-299723

(51) Int. Cl.
*F01N 13/08* (2010.01)
*F01N 13/00* (2010.01)

(52) U.S. Cl.
CPC ..... *F01N 13/00* (2013.01)
USPC ..... 180/296; 181/228

(58) Field of Classification Search
CPC . F01N 13/1805; F01N 13/00; F01N 2230/02; F01N 2260/10; F01N 2450/30
USPC ..... 180/296, 309; 248/49, 74.1, 74.4; 60/272
See application file for complete search history.

(56) References Cited

U.S. PATENT DOCUMENTS 2,025,789 A * 12/1935 Templin et al. ..... 138/106
4,060,143 A * 11/1977 Matsumoto et al. ..... 180/296
5,110,073 A * 5/1992 Schoenky ..... 248/49
5,570,861 A * 11/1996 Olsen et al. ..... 248/74.1
7,281,606 B2 * 10/2007 Marocco ..... 181/270
7,501,005 B2 * 3/2009 Thaler ..... 55/523
2011/0120085 A1 * 5/2011 Saito et al. ..... 60/272

FOREIGN PATENT DOCUMENTS

JP 59-141277 U 9/1984
JP 1-94691 U 6/1989
JP 10-317957 12/1998
JP 2002-339739 11/2002
JP 2003-104071 4/2003
JP 2005-113795 4/2005
JP 2005-337403 12/2005
JP 2010043572 A * 2/2010

OTHER PUBLICATIONS

U.S. Appl. No. 12/581,333, filed Oct. 19, 2009, Koji Okada.
Office Action issued Sep. 4, 2012 in Japanese Application No. 2008-299723 (With English Translation).

* cited by examiner

*Primary Examiner* — J. Allen Shriver, II
*Assistant Examiner* — Brian Cassidy
(74) *Attorney, Agent, or Firm* — Oblon, Spivak, McClelland, Maier & Neustadt, L.L.P.

(57) ABSTRACT

A muffler of a construction machine is formed by respectively coupling silencers to entrance and exit sides of an exhaust-gas purifying device by flanges. In flange coupling portions, mounting seats are provided integrally with lower semicircumferential portions of the flanges of the silencers in a manner such as to protrude toward outer peripheries of the flanges. By coupling the mounting seats to muffler mount brackets attached to a muffler mount, the muffler is mounted on the muffler mount.

4 Claims, 4 Drawing Sheets

CONSTRUCTION MACHINE

BACKGROUND OF THE INVENTION

1. Field of the Invention

The present invention relates to a muffler for use in an engine exhaust system, and to a construction machine, such as a hydraulic shovel, which includes a muffler mounting device for mounting the muffler to a frame of the machine.

2. Description of the Related Art

The background art will be described by taking a hydraulic shovel as an example.

FIG. 6 shows an upper rotating body mounted on a lower running body. Referring to FIG. 6, an operating attachment (not shown) including a boom, an arm, and a bucket is attached to one end (left end in the figure; hereinafter a side of the left end indicates the front side) of an upper frame 1 of the upper rotating body.

On an upper surface of the upper frame 1, vertical plates (sometimes referred to as main frames) 2 and 3 serving as strong members are provided on both left and right sides of the center in the left-right direction. The vertical plates 2 and 3 extend over the substantially entire length in the front-rear direction. On the upper surface of the upper frame 1, partition walls 4, 5, and 6 also extend in the front-rear direction in the rear of the upper frame 1. An engine room 7 is provided in a rear end portion of the upper frame 1 defined by the partition walls 4, 5, and 6.

In the engine room 7, an engine 8 is provided between the left and right vertical plates 2 and 3. On the left side of the engine 8, a cooling fan 9 and a heat exchanger 10, such as an intercooler, a radiator, or an oil cooler, are provided as cooling equipment.

On the right side of the engine 8, a hydraulic pump 11 is provided while being connected to an engine output shaft. A muffler 12 crosses above the hydraulic pump 11.

As a mounting device for the muffler 12, a muffler mount 13 overhangs from a fixed portion of the machine (e.g., a pump-side outer wall of the engine 8), and the muffler 12 is mounted on the muffler mount 13 by a U-bolt 14, as shown in FIG. 7 (see Japanese Unexamined Patent Application Publication Nos. 2003-104071 and 10-317957).

However, when the muffler 12 is mounted on the muffler mount 13 by the U-bolt, as in the related art, the clamping force of the U-bolt 14 directly acts on the outer periphery of the muffler 12, and the mounting portion is therefore susceptible to damage.

In a typical muffler, a silencer is coupled to each side of an exhaust-gas purifying device containing a catalyst. For this reason, if the exhaust-gas purifying device is clamped by a U-bolt, not only the outer periphery of the device, but also contents (catalyst) may be damaged by the clamping force.

SUMMARY OF THE INVENTION

Accordingly, it is an object of the present invention to provide a muffler in which a mounting portion, particularly, an exhaust-gas purifying device, is not damaged by a muffler mounting force, and a construction machine including a device for mounting the muffler.

A construction machine according to an aspect of the present invention includes silencers; a muffler including flange coupling portions in which the silencers are respectively coupled to entrance and exit sides of an exhaust-gas purifying device by flanges of the exhaust-gas purifying device and flanges of the silencers; and muffler mounting seats provided integrally with the flanges of at least one of the exhaust-gas purifying device and the silencers in the flange coupling portions on the entrance and exit sides. The muffler mounting seats protrude toward outer peripheries of the flanges and are attached to a fixed portion of the construction machine.

According to the aspect of the present invention, in the flange coupling portions between the exhaust-gas purifying device and the silencers, the mounting seats are provided integrally with the flanges of at least one of the exhaust-gas purifying device and the silencers in a manner such as to protrude toward outer peripheries of the flanges, and the muffler is attached to a fixed portion of the machine (a muffler mount provided at the fixed portion of the machine in a preferred embodiment that will be described below) by the mounting seats. Hence, the muffler mounting force does not directly act on the muffler itself, unlike the clamping force of the U-bolt adopted in the related art.

For this reason, the muffler including the exhaust-gas purifying device will not be damaged by the mounting force.

Further, the flanges for coupling the exhaust-gas purifying device and the silencers also function as members for mounting the muffler. This reduces the number of components for mounting the muffler, achieves cost reduction, and improves assembly efficiency.

Preferably, the mounting seats are provided in the flanges of the silencers.

In this case, when a construction machine manufacturer assembles a muffler by combining the manufacturer's silencers with an exhaust-gas purifying device purchased from a manufacturer specializing in the device, the construction machine manufacturer can machine flanges of the silencers in-house to form mounting seats. This reduces the machining cost.

Preferably, a muffler mount is provided in the fixed portion of the construction machine, and the muffler mounting seats are attached to the muffler mount to form a muffler mounting device of the construction machine.

Preferably, the mounting seats are provided substantially only in lower circumferential portions of the flanges, and the muffler mounting device is formed by coupling the muffler mounting seats to muffler mount brackets attached to the muffler mount.

In this case, since the muffler is mounted on the muffler mount while the mounting seats and the muffler mount brackets are coupled substantially only in the lower semicircumferential portion of the flanges, it is possible to more easily mount and assemble the muffler than in the case in which the mounting seats and the muffler mount brackets are circular and are coupled on the entire peripheries of the flanges.

DESCRIPTION OF THE PREFERRED EMBODIMENTS

Figure 1:
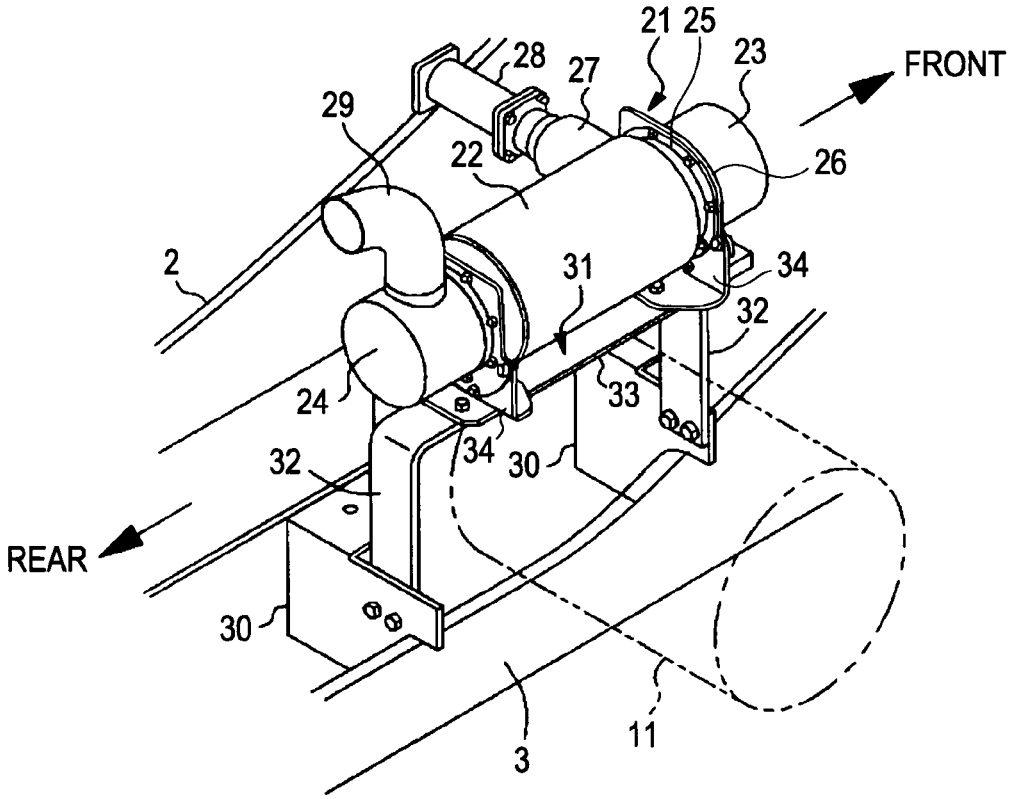
FIG. 1 is a perspective view of a muffler and a muffler mounting device according to an embodiment of the present invention.

An embodiment of the present invention will now be described with reference to FIGS. 1 to 5.

In the embodiment, the present invention is applied to a hydraulic shovel.

The embodiment is similar to the related art described above in BACKGROUND OF THE INVENTION in that an engine is mounted in an engine room provided in a rear end portion of an upper rotating body, in that a hydraulic pump 11 (shown by a two-dot chain line in FIGS. 1 and 2) is connected to a right side of the engine, and in that a muffler 21 crosses above the hydraulic pump 11.

The muffler 21 includes an exhaust-gas purifying device 22 and silencers 23 and 24. The exhaust-gas purifying device 22 removes nitrogen oxide (NOx) and particular matter (PM) from exhaust gas by using a catalyst contained therein. The silencers 23 and 24 are respectively provided on an entrance (engine) side and an exit side of the exhaust-gas purifying device 22. The exhaust-gas purifying device 22 and the silencers 23 and 24 are coupled in the longitudinal direction.

More specifically, flanges 25 and 25 provided at opposite ends in the longitudinal direction of the exhaust-gas purifying device 22 are coupled to flanges 26 and 26 provided at ends of the silencers 23 and 24 facing the exhaust-gas purifying device 22 by bolts and nuts at a plurality positions in the circumferential direction, whereby the exhaust-gas purifying device 22 and the silencers 23 and 24 are combined into the muffler 21.

The entrance-side silencer 23 is connected to the engine exhaust side via a bellows 27 and an engine exhaust pipe 28 that are made of metal (see FIG. 1), and the exit-side silencer 24 is connected to an exhaust duct 29.

Figure 6:
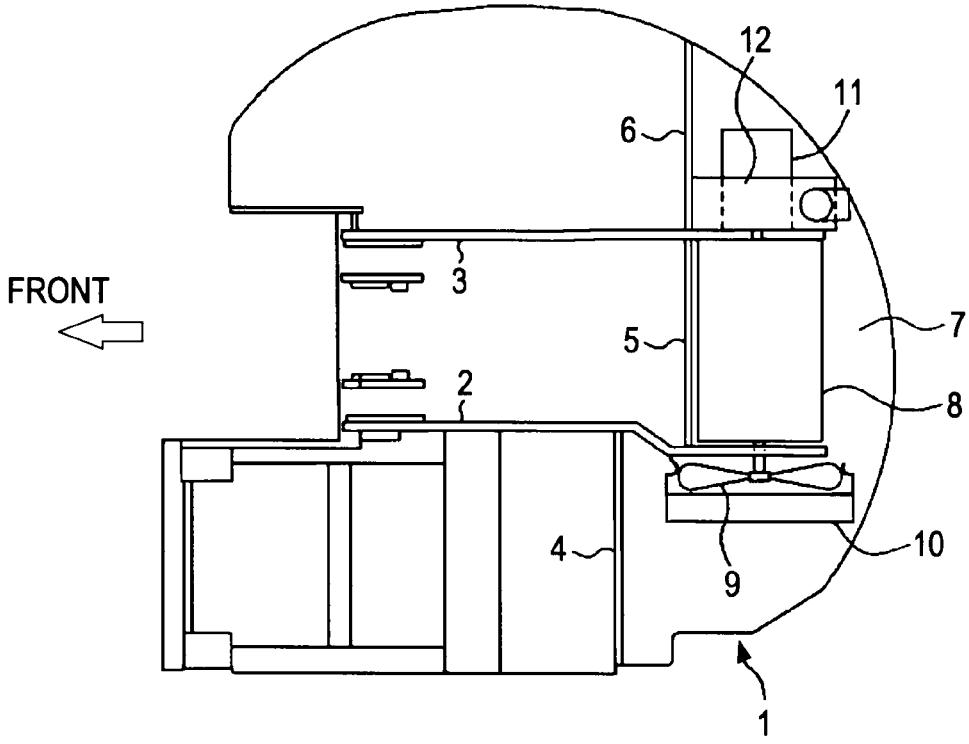
FIG. 6 is a schematic plan view showing the arrangement of components on an upper frame and in an engine room of a hydraulic shovel.
Figure 7:
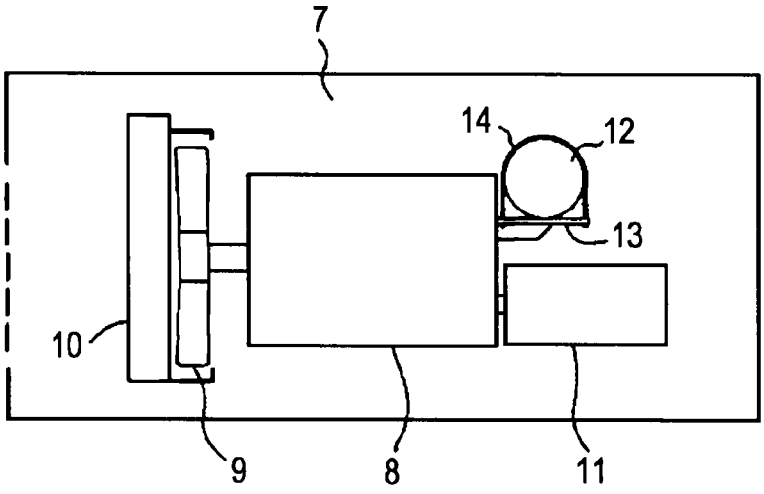
FIG. 7 is a rear view showing the arrangement of the components.

Left and right vertical plates 2 and 3 are provided on an upper frame of the upper rotating body. On front and rear sides of an upper surface of the right vertical plate 3, engine mount brackets (hereinafter simply referred to as mount brackets) 30 and 30 are provided as fixed portions of the machine so as to support one end of an engine 8 shown in FIGS. 6 and 7. A muffler mount 31 for supporting the muffler 21 is attached to the mount brackets 30.

The muffler mount 31 is shaped like a gate defined by three separate members, namely, a pair of leg portions 32 and 32 opposing at a distance from each other in the front-rear direction, and a muffler mounting portion 33 horizontally spanned between upper ends of the leg portions 32. Lower ends of the leg portions 32 are attached to the front and rear mount brackets 30 with bolts and nuts (unnumbered).

Figure 2:
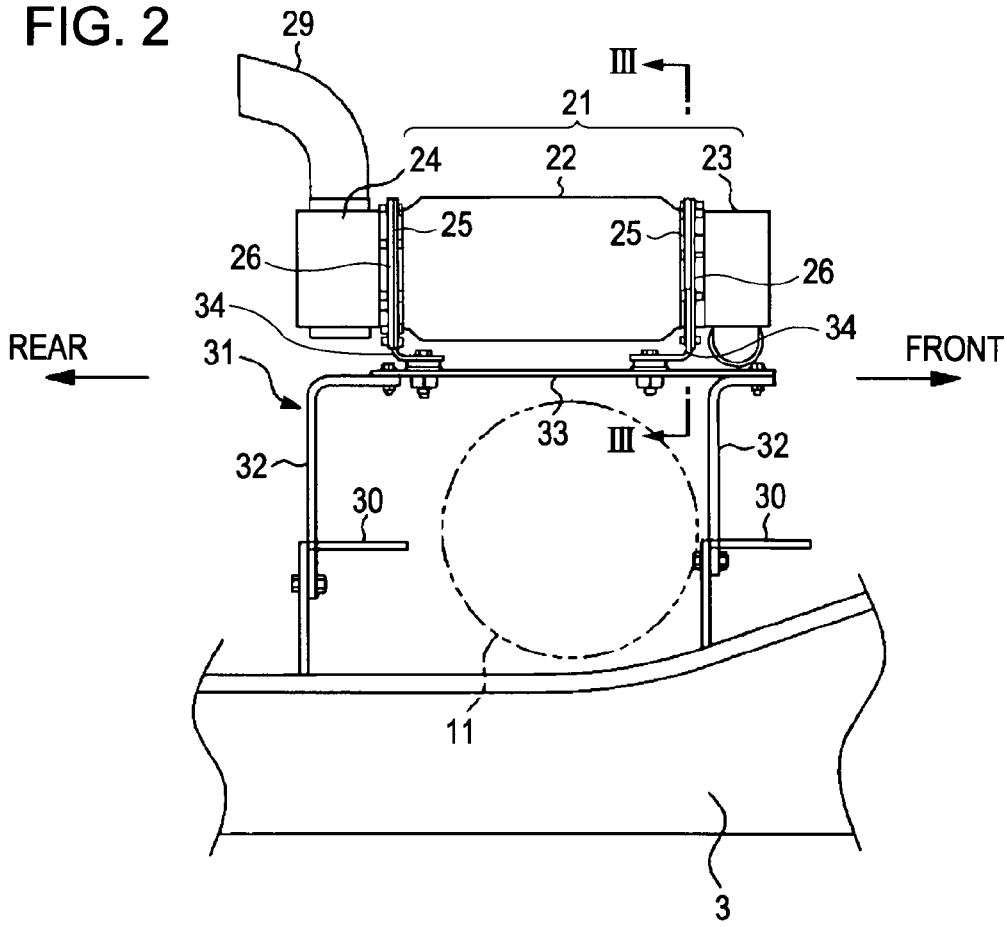
FIG. 2 is a side view of the muffler and the muffler mounting device of the embodiment.

Thus, the gate-shaped muffler mount 31 is mounted in the engine room in a manner such as to cross above the hydraulic pump 11, as shown in FIGS. 1 and 2.

Since the gate-shaped muffler mount 31 crosses above the hydraulic pump 11 in this way, it does not interfere with attachment and detachment of the hydraulic pump 11, and allows the muffler 21 to be mounted at the same position as before. In other words, there is no need to change the layout and dimensions of the hydraulic pump 11 and the other peripheral devices, and this structure can be easily applied to existing machines.

Further, since the weight of the muffler 21 can be supported at both ends by the gate-shaped muffler mount 31 and the muffler mount 31 is attached to the vertical plate 3 serving as the strong member with the mount brackets 30 being disposed therebetween, it is possible to stably support the heavy muffler 21 including the exhaust-gas purifying device 22.

In addition, since the mount brackets 30 for supporting the engine also function as brackets for mounting the muffler mount 31, the muffler mounting structure can be simplified. This achieves cost reduction.

A detailed description will now be given of the structure for mounting the muffler 21 on the muffler mount 31.

Mounting seats 26*a* and 26*a* are respectively provided integrally with the flanges 26 of the silencers 23 and 24 at both ends of the muffler 21. The mounting seats 26*a* protrude outward from lower semicircumferential portions of the flanges 26.

Muffler mount brackets 34 and 34 are respectively attached to front and rear sides of an upper surface of the muffler mounting portion 33 in the muffler mount 31.

Figure 3:
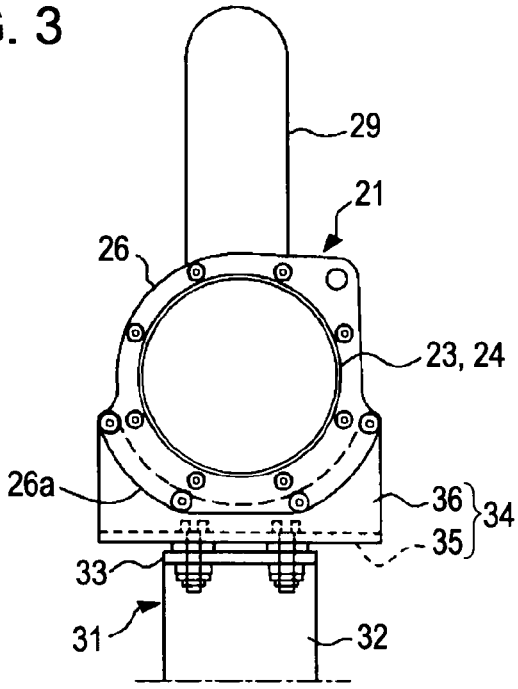
FIG. 3 is an enlarged sectional view, taken along line III-III in FIG. 2.
Figure 4:
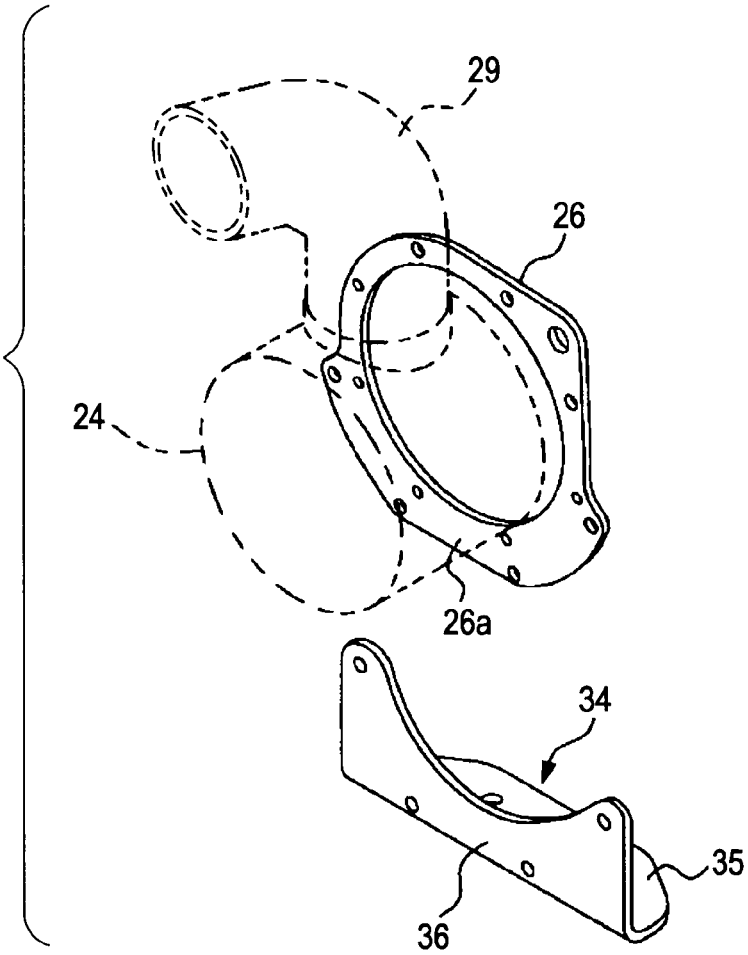
FIG. 4 is a perspective view showing a state in which a silencer-side flange and a muffler mount bracket are not coupled in the embodiment.

As shown in FIGS. 3 to 4 serving as enlarged views, each of the muffler mount brackets 34 is L-shaped by a horizontal base 35 and a flange coupling portion 36 extending from the base 35 upward in the vertical direction. The base 35 is attached to the muffler mounting portion 33 of the muffler mount 31 by bolts and nuts (unnumbered).

Upper edges of the flange coupling portions 36 are semicircular arc-shaped substantially corresponding to the mounting seats 26*a* on the muffler side. The mounting seats 26*a* are placed on the flange coupling portions 36 in the front-rear direction by a plurality of bolts and nuts (unnumbered).

Figure 5:
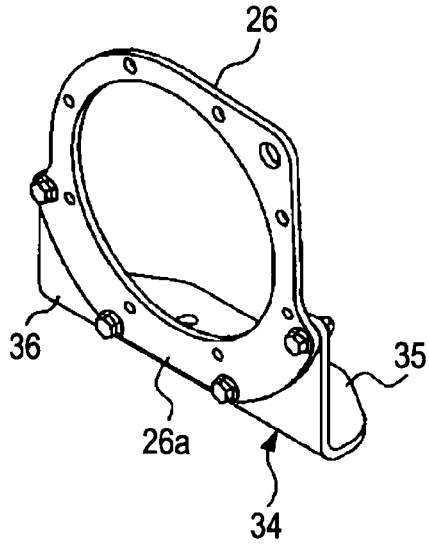
FIG. 5 is a perspective view showing a state in which the silencer-side flange and the muffler mount bracket are coupled.

While FIGS. 4 and 5 illustrate only the flange mounting portion at the exit-side silencer 24, the flange mounting portion at the entrance-side silencer 23 is exactly the same as the flange mounting portion at the exit-side silencer 24.

In this way, at the flange mounting portions between the exhaust-gas purifying device 22 and the silencers 23 and 24, the mounting seats 26*a* are formed integrally with the silencer-side flanges 26 by protruding the lower semicircumferential portions of the flanges 26 outward, and the muffler 21 is mounted on the muffler mount 31 by the mounting seats 26*a*. For this reason, the force for mounting the muffler 21 does not directly act on the muffler 21 itself, unlike the technique of clamping the muffler by the U-bolt.

Hence, the muffler 21 including the exhaust-gas purifying device 22 will not be damaged by the mounting force.

Further, the flanges 26 for coupling the exhaust-gas purifying device 22 and the silencers 23 and 24 also function as members for mounting the muffler 21. For this reason, the number of components for mounting the muffler 21 is reduced. This achieves cost reduction and improves assembly efficiency.

In addition, since the mounting seats 26*a* are provided in the flanges 26 of the silencers 23 and 24, when a construction machine manufacturer assembles the muffler 21 by combining the manufacturer's silencers 23 and 24 with an exhaust-gas purifying device 22 purchased from a manufacturer specializing in the device, the construction machine manufacturer can machine the silencer flanges 26 in-house to form the mounting seats 26*a*. This reduces the machining cost.

The muffler 21 is mounted on the muffler mount 31 in a state in which the mounting seats 26*a* and the muffler mount brackets 34 are coupled substantially only in the lower semicircumferential portions (mounting seats 26*a*). For this reason, it is possible to more easily mount and assemble the muffler 21 than in the case in which the mounting seats 26*a* and the muffler mount brackets 34 are circular and are coupled together on the entire peripheries of the flanges 26.

Other Embodiments (1) While the flanges 26 on the silencer side have the mounting seats 26*a* in the above-described embodiment, the flanges 25 on the exhaust-gas purifying device side may have mounting seats, similarly to the above. Alternatively, both the flanges 25 on the exhaust-gas purifying device side and the flanges 26 on the silencer side may have mounting seats so that the muffler mount brackets 34 are attached to both the mounting seats.

(2) Instead of being provided only in the lower circumferential portions of the flanges, the mounting seats may be provided in a range wider than the lower semicircumferential portions or over the entire periphery.

(3) While the muffler mount 31 is attached to the right vertical plate 3 with the mount brackets 30 being disposed therebetween in the above-described embodiment, it may be attached to the frame of the machine at a position different from the vertical plate 3 with an exclusive bracket. Alternatively, the muffler mount 31 may be attached to other fixed portions of the machine, for example, an outer wall of the engine.

Although the invention has been described with reference to the preferred embodiments in the attached figures, it is noted that equivalents may be employed and substitutions made herein without departing from the scope of the invention as recited in the claims.

What is claimed is:

1. A construction machine comprising a muffler including an exhaust-gas purifying device and a plurality of silencers, and muffler mount brackets for attaching the muffler to a fixed portion of the construction machine, wherein the muffler includes:

flange coupling portions comprising flanges of the exhaust-gas purifying device and flanges of the silencers, in which the silencers are respectively coupled to entrance and exit sides of the exhaust-gas purifying device by coupling the flanges of the exhaust-gas purifying device and the flanges of the silencers by first bolts and first nuts at a plurality of positions in the circumferential direction; and muffler mounting seats provided integrally with the flanges of the silencers in the flange coupling portions on the entrance and exit sides, the muffler mounting seats protruding toward outer peripheries of the flanges being provided only in lower semi-circumferential portions of the flanges and being attached to the muffler mount brackets by second bolts and second nuts, wherein said lower semi-circumferential portions of the flanges consist of portions located below a horizontal line passing through a center of the silencers, wherein, in a state where all of the pairs of the first bolts and the first nuts are uncoupled, the flanges of the exhaust-gas purifying device and the flanges of the silencers are detachable from each other while the muffler mounting seats are integrally provided with the flanges of the silencers, wherein, in a state where all of the pairs of the second bolts and the second nuts are uncoupled, the muffler mounting seats are detachable from the muffler mount brackets while the muffler mounting seats are integrally provided with the flanges of the silencers, and wherein the muffler mount brackets include a seat coupling portion coupled to the muffler mounting seats only in the lower semi-circumferential portions of the flanges along a circumferential direction of flanges of the silencers.

2. The construction machine according to claim 1, further comprising a muffler mount provided in the fixed portion of the construction machine, wherein the muffler mounting seats are attached to the muffler mount.

3. A construction machine comprising a muffler including an exhaust-gas purifying device and a plurality of silencers, and muffler mount brackets for attaching the muffler to a fixed portion of the construction machine, wherein the muffler includes:

flange coupling portions comprising flanges of the exhaust-gas purifying device and flanges of the silencers, the flanges of the exhaust-gas purifying device and flanges of the silencers each having at least a portion extending along the radial direction, and in which the silencers are respectively coupled to entrance and exit sides of the exhaust-gas purifying device by coupling the flanges of the exhaust-gas purifying device and the flanges of the silencers to one another at the radially extending portions thereof, using first bolts and first nuts provided at a plurality of positions in the circumferential direction, whereby tightening of the first bolts presses the flanges together in the axial direction of the exhaust-gas purifying device; and muffler mounting seats provided integrally with the flanges of the silencers at the flange coupling portions on the entrance and exit sides, the muffler mounting seats protruding outward in the radial direction toward outer peripheries of the flanges only in lower semi-circumferential portions of the flanges and being attached to the muffler mount brackets by second bolts and second nuts, wherein, in a state where all of the pairs of the first bolts and the first nuts are uncoupled, the flanges of the exhaust-gas purifying device and the flanges of the silencers are detachable from each other while the muffler mounting seats are integrally provided with the flanges of the silencers, wherein, in a state where all of the pairs of the second bolts and the second nuts are uncoupled, the muffler mounting seats are detachable from the muffler mount brackets while the muffler mounting seats are integrally provided with the flanges of the silencers, and wherein the muffler mount brackets include a seat coupling portion coupled to the muffler mounting seats being provided only in the lower semi-circumferential portions of the flanges along a circumferential direction of flanges of the silencers, wherein said lower semi-circumferential portions of the flanges consist of portions located below a horizontal line passing through a center of the silencers.

4. A construction machine comprising a muffler including an exhaust-gas purifying device and a plurality of silencers, and muffler mount brackets for attaching the muffler to a fixed portion of the construction machine, wherein the muffler includes:

flange coupling portions comprising flanges of the exhaust-gas purifying device and flanges of the silencers, in which the silencers are respectively coupled to entrance and exit sides of the exhaust-gas purifying device by coupling the flanges of the exhaust-gas purifying device and the flanges of the silencers by first bolts and first nuts at a plurality of positions in the circumferential direction; and muffler mounting seats provided integrally with the flanges of the silencers at the flange coupling portions on the entrance and exit sides and not provided integrally with the flanges of the exhaust-gas purifying device, the muffler mounting seats protruding toward outer peripheries of the flanges only in lower semi-circumferential portions of the flanges and being attached to the muffler mount brackets by second bolts and second nuts which exclude first bolts and first nuts, wherein, in a state where all of the pairs of the first bolts and the first nuts are uncoupled, the flanges of the exhaust-gas purifying device and the flanges of the silencers are detachable from each other while the muffler mounting seats are integrally provided with the flanges of the silencers, wherein, in a state where all of the pairs of the second bolts and the second nuts are uncoupled, the muffler mounting seats are detachable from the muffler mount brackets while the muffler mounting seats are integrally provided with the flanges of the silencers, and wherein the muffler mount brackets include a seat coupling portion coupled to the muffler mounting seats being provided only in the lower semi-circumferential portions of the flanges along a circumferential direction of flanges of the silencers, wherein said lower semi-circumferential portions of the flanges consist of portions located below a horizontal line passing through a center of the silencers.

* * * * *